US006551124B1

(12) United States Patent
Gossmann

(10) Patent No.: US 6,551,124 B1
(45) Date of Patent: Apr. 22, 2003

(54) CONTACTING DEVICE FOR A FLAT BAND CABLE

(75) Inventor: Christian Gossmann, Habsheim (FR)

(73) Assignee: Woertz AG, Muttenz (CH)

( * ) Notice: Subject to any disclaimer, the term of this patent is extended or adjusted under 35 U.S.C. 154(b) by 0 days.

(21) Appl. No.: 09/856,225

(22) PCT Filed: Sep. 19, 2000

(86) PCT No.: PCT/EP00/09168

§ 371 (c)(1),
(2), (4) Date: Aug. 16, 2001

(87) PCT Pub. No.: WO01/22534

PCT Pub. Date: Mar. 29, 2001

(30) Foreign Application Priority Data

Sep. 20, 1999 (DE) ..... 199 45 039
Oct. 16, 1999 (DE) ..... 199 49 919

(51) Int. Cl.[7] ..... H01R 4/24; H01R 4/26; H01R 11/20

(52) U.S. Cl. ..... 439/411; 439/425

(58) Field of Search ..... 439/492, 495, 439/497, 411, 426, 404, 417, 425

(56) References Cited

U.S. PATENT DOCUMENTS

| | | | | | |
|---|---|---|---|---|---|
| 3,571,779 | A | * | 3/1971 | Collier | 361/633 |
| 4,634,206 | A | | 1/1987 | Harting et al. | 339/103 M |
| 4,743,080 | A | * | 5/1988 | Siraty | 439/492 |
| 5,161,881 | A | * | 11/1992 | Myson | 362/249 |
| 5,266,057 | A | * | 11/1993 | Angel et al. | 411/393 |
| 5,453,022 | A | | 9/1995 | Staiger et al. | 439/404 |
| 5,722,852 | A | * | 3/1998 | Miek | 439/417 |
| 6,027,367 | A | * | 2/2000 | Woertz et al. | 174/59 |

FOREIGN PATENT DOCUMENTS

| | | |
|---|---|---|
| DE | G 85 11 822.2 | 8/1985 |
| DE | G 93 02 630.7 | 8/1994 |
| DE | 295 01 970 U1 | 7/1996 |
| DE | 196 18 998 C1 | 1/1998 |
| DE | 196 30 352 A1 | 1/1998 |
| DE | 297 12 043 U1 | 9/1998 |
| DE | 19 729 411 A1 | 2/1999 |
| DE | 198 44 862 A1 | 5/1999 |
| EP | 0 164 800 A1 | 12/1985 |
| EP | 0 665 608 A2 | 12/1994 |
| EP | 0 821 434 A1 | 7/1997 |
| GB | 1 385 357 | 2/1975 |
| GB | 2 289 580 | 11/1995 |

OTHER PUBLICATIONS

*International Search Report* corresponding to International Patent Application Ser. No. PCT/EP00/09168, dated Jan. 2, 2001, 7 pages.

* cited by examiner

*Primary Examiner*—Lynn D. Feild
*Assistant Examiner*—Chandrika Prasad
(74) *Attorney, Agent, or Firm*—Marshall, Gerstein & Borun

(57) ABSTRACT

In order to achieve a high degree of protection, especially a degree of protection IP67 with the simplest possible sealing system in contacting device, a sealing ridge is provided on housing top, which cooperates with a gasket. For reliable sealing, this is preferably arranged continuously around a contact region and is forced into the preferably plate-like gasket in the installed state. During contacting of the conductors of ribbon cable, a contacting element, for example, of contact screw penetrates the gasket and in so doing displaces sealing material, which additionally contributes to sealing. The contacting device is preferably designed as an adapter for a field bus system or as a so-called "heavy rectangular plug-in connector".

15 Claims, 4 Drawing Sheets

CONTACTING DEVICE FOR A FLAT BAND CABLE

FIELD OF INVENTION

The invention concerns a contacting device for a ribbon cable with a housing top enclosing a number of contacting elements and with a housing bottom, between which the ribbon cable can be passed, a gasket being provided that seals the housing top against the ribbon cable when it is installed.

BACKGROUND OF THE INVENTION

Ribbon cables are used in a number of areas, for example, in building technology, in the automotive sector or in industrial control and automation technology. They are used both for electrical power supply in the low voltage range, for example, for an electrical system in a vehicle, and also in the ordinary voltage range of a few 100 V for building installation. The ribbon cables have several electrical conductors arranged next to each other, some of which can be used for power supply and some as communications lines.

It is often desirable, especially in building technology and in industrial control and automation technology, to arrange electrical equipment in a spatially flexible manner and to connect it without laying costly installation lines. A ribbon cable laid through the room is particularly suited for this purpose, via which power and communication supply for the connected equipment can occur. The equipment can be connected to the ribbon cable at any location in the room via contacting devices. Both power supply and communication of equipment with each other or with a central office is therefore achieved via ribbon cables. A bus system (field bus) is preferably provided for this. The bus system can be designed as a power bus and/or data bus. In this case the contacting device is designed as a bus adapter, via which the equipment can be connected to the bus system. This type of electrical installation system designed as a bus system is known from EP 0 665 608 A2.

The contacting device is primarily prescribed for those applications in which the conductors of an ordinary ground cable are to be contacted with those of a ribbon cable. A known technique for contacting is so-called penetration contacting in which the contact pins penetrate the covering of the ribbon cable and the insulation of the conductors being contacted. For reliable and permanent contacting, the contact region must be protected from penetration of dirt and water. Different degrees of protection are established by European Standard EN 60 529. The degree of protection IP67 is sought for contacting equipment.

A contacting device of the type just mentioned is known from DE 196 18 998 C1. To achieve a high degree of protection, a sealing element is provided between the ribbon cable and the housing top. This consists essentially of connected O rings. The contact pins or contacting elements are passed through the openings of the O rings and penetrate into the ribbon cable. The sealing element additionally has an elevation on its outer edge in the form of a spring that engages in a correspondingly shaped groove in the housing top. Sealing is obtained via the O rings between the ribbon cable and sealing element and sealing between the sealing element and the housing top is obtained via the groove-spring configuration. A shortcoming in this variant is the complex configuration of the sealing element and the fact that fitting into the groove of the housing top must occur.

OVERVIEW

The underlying task of the present invention is to offer a contacting device with a simply configured sealing system that guarantees a high degree of protection.

According to it a sealing ridge is provided on the housing top that cooperates with the gasket. Sealing between the gasket and housing top then occurs so that the gasket is pressed against the sealing ridge during assembly. Because of this, reliable sealing is achieved. At the same time the need for a demanding groove-spring configuration drops out, since the gasket need not have a groove in the region of the sealing ridge.

The sealing ridge in a preferred variant is molded directly onto the housing top. It is therefore an integral component of the housing top, which is designed in particular as an injection molded part. This facilitates manufacture.

To achieve the highest possible tightness, the sealing ridge in an advantageous embodiment is arranged continuously around a contacting region in which the contacting elements are situated.

Preferably the sealing ridge tapers to a point in the direction toward the gasket so that the sealing ridge in the installed state presses into the gasket and high sealing is achieved. For example, the sealing ridge is designed to be triangular when viewed in cross section for this purpose. For a simple configuration of the gasket, it is preferably designed to be flat. The gasket is therefore a flat seal and, for example, a rubber strip.

The gasket is preferably designed essentially to be continuous, i.e., has no recesses especially in the region of the contacting elements. This applies at least for the uninstalled state. This has the advantage of extremely simple configuration of the gasket.

The continuous gasket also favors reliable sealing between the gasket and ribbon cable when the contacting element is traversed by the gasket during assembly. The contacting element then displaces the sealing material, which is closely conformed around the contacting element, on the one hand, and forms a small bulge toward the ribbon cable on the bottom of the gasket, on the other hand, which almost has the effect of an O ring. In preferred variants, the contacting elements are guided through the gasket in the installed state, which lie tight against the contacting elements. The contacting elements are then preferably guided through the gasket, the sealing material displaced by the contacting elements forming a continuous bulge around the corresponding contacting element which serves for sealing of the ribbon cable to the corresponding contacting elements. This sealing can be achieved regardless of the sealing obtained via the sealing ridge.

The contacting elements preferably have screws for screwing into the ribbon cables. Contact with the conductors of the ribbon cable is therefore produced via the screws. In contrast to simply designed contacting pins, the screws have the advantage that greater forces can be exerted with them. They are particularly suited for relatively strongly designed ribbon cables. In addition, the penetration depth into the ribbon cable can be adjusted with the screws.

For rapid and simple assembly, the housing bottom preferably has a guide rail into which the housing top can be inserted by means of a guide element. The guide rail is designed for this purpose as a simple profile rail, for example.

The guide rail and guide element then preferably cooperate in the fashion of a hinge. A clearance is set for this purpose preferably between the guide rail and guide element so that swiveling of the two housing parts around a pivot axis formed by the guide rail and guide element is possible. This permits simple assembly of the ribbon cable, since this is inserted into the two swiveled out housing parts, which are then swung back. The two housing parts are appropriately joined, for example, screwed, on the side opposite the guide rail.

In a preferred variant, the housing top is part of a plug-in connector, especially part of the rectangular plug-in connector. The housing top has contact bushings for this purpose to receive contact pins. These are mounted on a plug housing, which is placed on the housing top. It is particularly advantageous if the housing top and plug housing also have means of sealing in order to also achieve degree of protection IP67 for the plug-in connectors.

Such plug-in connectors are known as so-called heavy rectangular plug-in connectors, especially in the field of industrial control and automation technology.

To permit use of the contacting device in a field bus system, for example, in a power bus and/or data bus system, the contacting device is preferably designed as a field bus adapter. Bus subscribers can be connected to the ribbon cable forming the bus lines of the field bus via the adapters.

In an expedient embodiment, the device comprises a control unit, via which the equipment coupled to the field bus can be controlled. For this purpose the control unit has a display and operating element. This has the significant advantage that functions ordinarily arranged in central switch cabinets are arranged decentralized directly in the area of the electrical machine. This increases the user friendliness and simplifies the search for errors, since intricately laid out switch cabinets can largely be dispensed with.

In a particularly expedient embodiment, the adapter has an adapter bottom and an adapter top, in which the latter can be mounted on the adapter bottom. The adapter bottom carries the contacting mechanism, i.e., the contact pins, for contacting with the ribbon cable. The adapter top includes the electronics of the adapter, for example, the electronics of the control unit. The adapter top and adapter bottom are connected to each other in the fashion of a plug-in connector. This has the decisive advantage that the adapter top carrying the electronics can be simply mounted and also simply replaced. This permits the adapter to be easily adapted to different requirements, in which case the adapter top is replaced. The adapter top is preferably also simply replaced for elimination of defects.

A plug connection is preferably integrated in the housing top. The plug connection is configured here, for example, as a connection for a communications line to a communications device or as a connection to a power supply for an electrical load. The plug connection is preferably designed as a connection for a circuit board plug-in connector. Integration of a plug connection in the housing top has the advantage relative to plug-in connectors that the plug connection is arranged internally in the housing top so that means of sealing, as required in a plug-in connector, are not necessary.

BRIEF DESCRIPTION OF THE DRAWINGS

Practical examples of the invention are further explained with reference to the drawing. In the drawing FIG. 1 schematically depicts an exploded view of a contacting device, FIG. 2 schematically depicts a section through a contacting device in the installed state and FIGS. 3 and 4 each schematically depict a housing top in a perspective top view, FIG. 5 schematically depicts a contacting device designed as a bus adapter.

Equivalent parts are provided with the same reference numbers in the individual figures.

DESCRIPTION OF THE PREFERRED EMBODIMENTS

Figure 1:
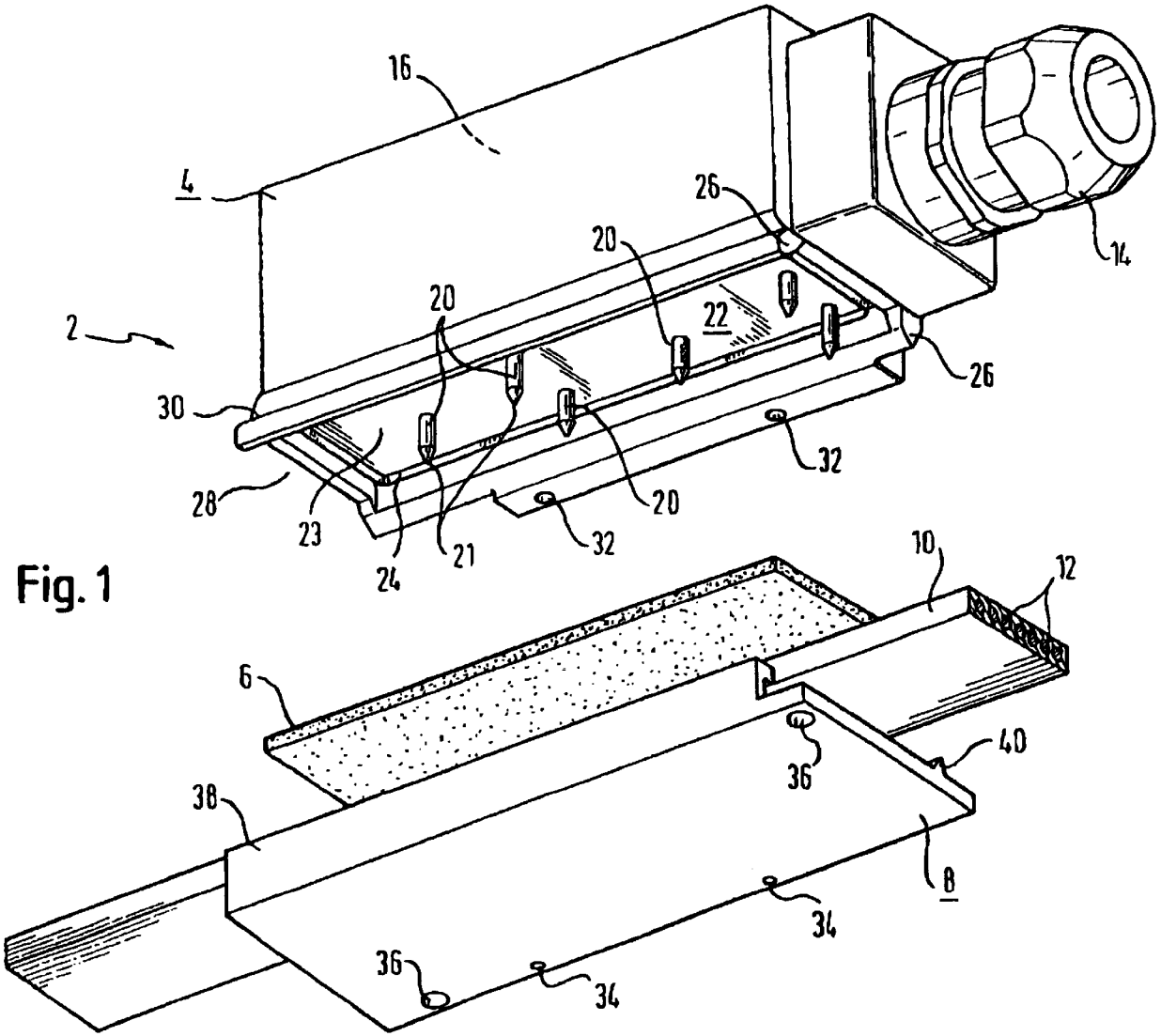

According to FIG. 1, the contacting device 2 comprises a housing top 4, a gasket 6 and housing bottom 8. A ribbon cable 10 with a number of conductors 12 is inserted between housing bottom 8 and gasket 6.

The housing top 4 has a connection 14 for a round cable. The round cable is introduced into the internal space 16 of the housing top where its conductors are connected to contacting element 18 (cf. FIGS. 3 and 4). Only contact pins or contact screws 20 of the individual contacting elements 18 are apparent in FIG. 1. The contact screws 20 have a contact tip 21 on the end and penetrate the bottom 23 of the housing top 4 in a contact region.

The contact region 22 is fully enclosed by a sealing ridge 24. The sealing ridge 24, also called a sealing rib, therefore forms a continuous elevation on the outside of bottom 23 facing the gasket 6. The housing top 4 also has two side connectors 26 on its bottom, which form a longitudinal recess 28 to receive the ribbon cable 10. The left side connector 26 is then designed as guide element 30. The right side connector 26 has two holes through which screws (not shown) are guided and screwed into corresponding threaded holes 34 in housing body 8 in order to fasten the two housing parts 4, 8 together.

In addition to the threaded holes 34, the housing bottom 8 has two additional fastening holes 36, with which the housing bottom 8 can be fastened to a wall. The housing bottom 8 also includes a guide rail 38 corresponding to guide element 30, as well as two positioning connectors 40 for precise lateral positioning of the ribbon cable 10. Only one of the two positioning connectors 40 is apparent in FIG. 1. The housing bottom 8 is preferably made from a metal, especially a light metal, for example, aluminum, for the best possible stability. The housing top 4 is preferably a plastic injection molded part, the sealing ridge 24 being an integral component of housing top 4. The sealing ridge 24 forms an assembly with housing top 4.

The gasket 6 is preferably designed as a rubber seal and laid out as a flat rubber strip. It preferably has no elevations, recesses or holes. Positioning holes are preferably provided only for its positioning on bottom 23 into which positioning pins fastened on bottom 23 engage (not shown).

The following procedure is used for contacting of conductor 12 with ribbon cable 10: the gasket 6 is inserted in the bottom 23 of housing top 4 and covers the contact region 22. The contact screws 20 at this point protrude only slightly or not at all from bottom 23. The gasket 6 is preferably held in a recess of bottom 23 by means of appropriate retaining elements, for example, the mentioned positioning pin. The housing top 4 is then pushed with its guide element 30 into the guide rail 38 of housing bottom 8. Guide element 30 and guide rail 38 are then configured so that the two housing parts 4, 8 can be rotated or tilted opposite each other. For insertion of ribbon cable 10 between positioning connectors 40, the two housing parts 4, 8 are swiveled away from each other. After insertion, the housing top 4 is fastened to housing bottom 8 by screws. For contacting, the contact screws 20 are now screwed into ribbon cable 10 until the contact tips 21 contact the corresponding conductors 12.

Figure 2:
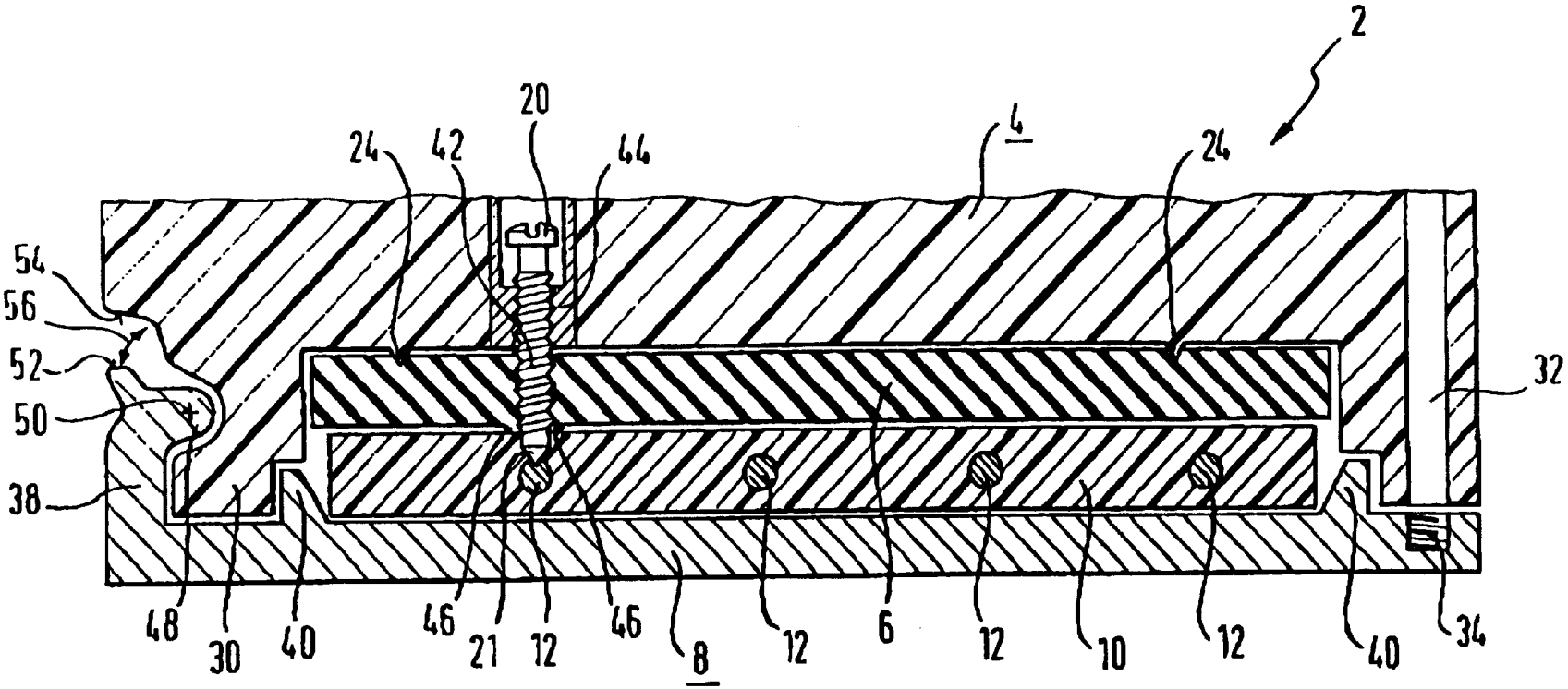

In the contacting device 2 depicted in FIG. 2, for reasons of clarity, the spacings between the individual elements are shown larger than the actually occurring spacings. According to FIG. 2, the sealing ridge 24 is designed triangular when viewed in cross section, i.e., tapers to a point in the direction of gasket 6. During assembly, the tip presses into the gasket 6 and reliably seals the housing top 4 so that neither dirt nor moisture can reach the depicted contacting screw 20.

The contacting screw 20 has a thread 42 with which it can be screwed into a threaded element of the housing part 4, for example, a threaded insert 44. The threaded insert 44 is made of conducting material and connected in conducting fashion to a corresponding conductor of the ground cable. During assembly, the contacting screw 20 is passed through gasket 6. The gasket is then displaced. Owing to the elasticity of the sealing material, this is pressed into the threads and therefore causes sealing. In addition, the material displaced by the contacting screw 20 is at least partly entrained outward and forms a bulge 46 around contacting screw 20. This bulge 46 acts roughly like a sealing ring. In the installed state, bulge 46 is generally fully compressed and sealed flat with the bottom of gasket 6.

The positioning connectors 40 are conically shaped in order to permit simple insertion of the ribbon cable 10 and at the same time guarantee precise lateral positioning.

An example of shaping of the guide rail 38 and guide element 30 is shown in FIG. 2. According to it, the guide rail 38 is bent at a right angle when viewed in cross section and forms a protrusion or undercut 48 that keeps the guide element 30 in the vertical position. For fixation in the horizontal position, the guide element 30 is arranged between the guide rail 38 and a positioning connector 40. To permit a tilting movement of housing top 4 relative to housing bottom 8 around a pivot axis 50, sufficient clearance is provided between the bend forming undercut 48 and guide element 30. For this purpose, the bend runs horizontally at the top, while the guide element 30 is designed to run obliquely relative to this top. The guide rail 38 also has a stop 52 that limits the tilt angle. In the swiveled out housing top 4, the housing top 4 comes to lie against stop 52 with a counterstop 54. The pivoting movement around pivot axis 50 is indicated by arrow 56.

Figures 3, 4:
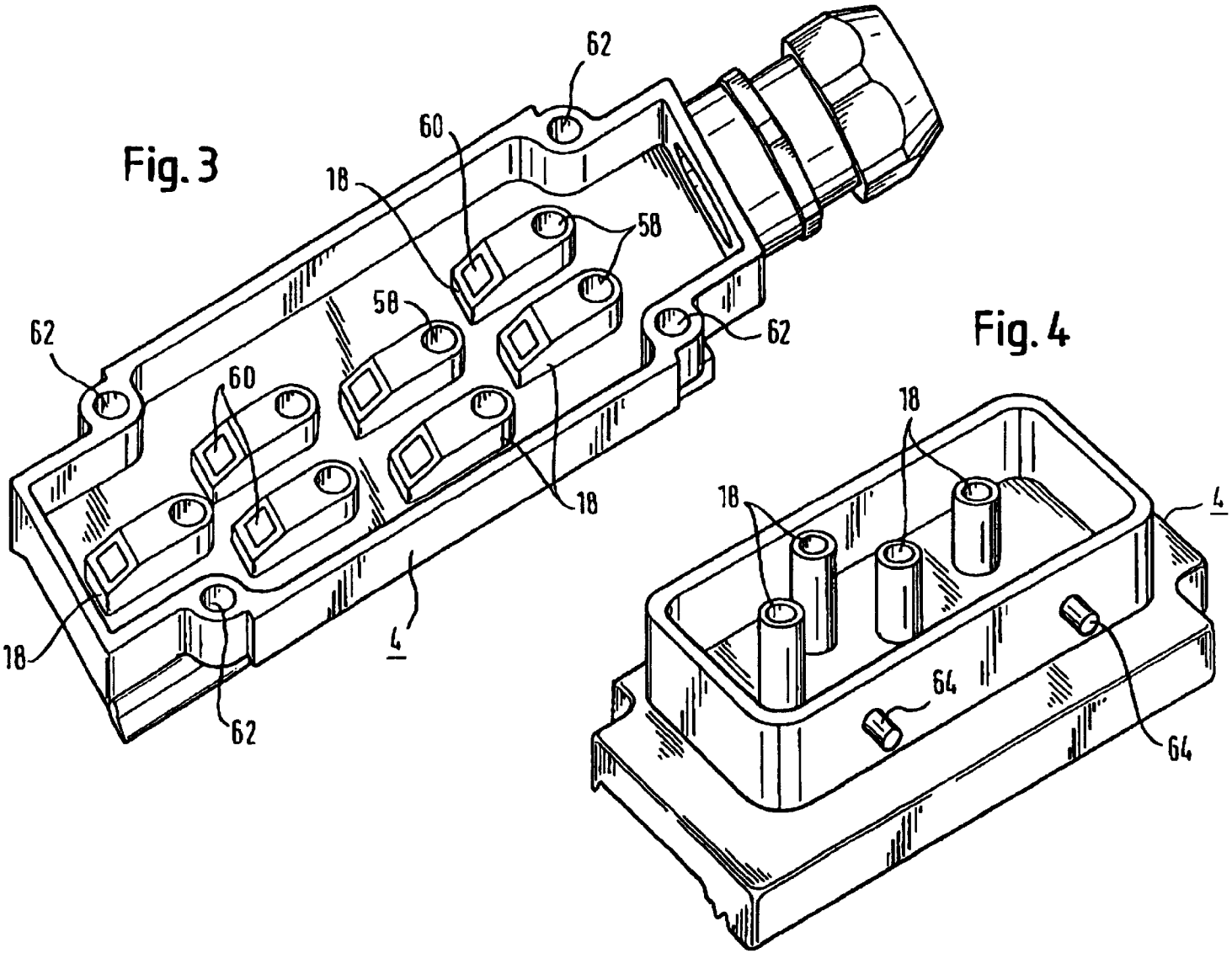

According to FIG. 3, several contacting elements 18 are provided in the interior 16 of housing top 4 in the form of connection terminals. Each of these has a mount 58 for the contacting screws 20 and a clamping region 60 for connection of a conductor of the round cable introduced via connector 14. The clamping region 60 is arranged on the side of the contacting element 18 facing away from connector 14. The conductors introduced via connector 14 are fastened in clamping region 60, which is conductively connected to contact screws 20. Four fastening positions 62 for fastening of the housing cover are provided on housing top 4.

An alternative configuration of housing top 4 is shown in FIG. 4, according to which the contacting elements 18 are designed as contact bushings to receive contact plugs. In the practical example four contacting elements 18 are shown. The contact plugs are preferably mounted in a plug housing (not shown in the figure) (also called a counterplug), which can be fastened to housing top 4 via locking pin 64. The housing top 4 forms a plug-in connector with the plug housing. A locking clamp of the plug housing engages in the locking pin 64 in order to connect the plug housing firmly to the housing top. In order to also achieve tightness according to IP67 on the contact surface between the housing top and plug housing, a seal is arranged between the housing parts. Tightness is achieved as soon as the plug housing is pressed onto the housing top by means of the closure mechanism, which consists of the locking pin 64 and the corresponding locking clamps. Such plug connectors are used, for example, in the automotive field and especially in industrial control and automation technology, where they are known as so-called "heavy rectangular plug-in connections". The housing top 4 is therefore configured so that it is compatible with the plug housing of such heavy rectangular plug-in connectors ordinarily used in control and automation technology.

Figure 5:
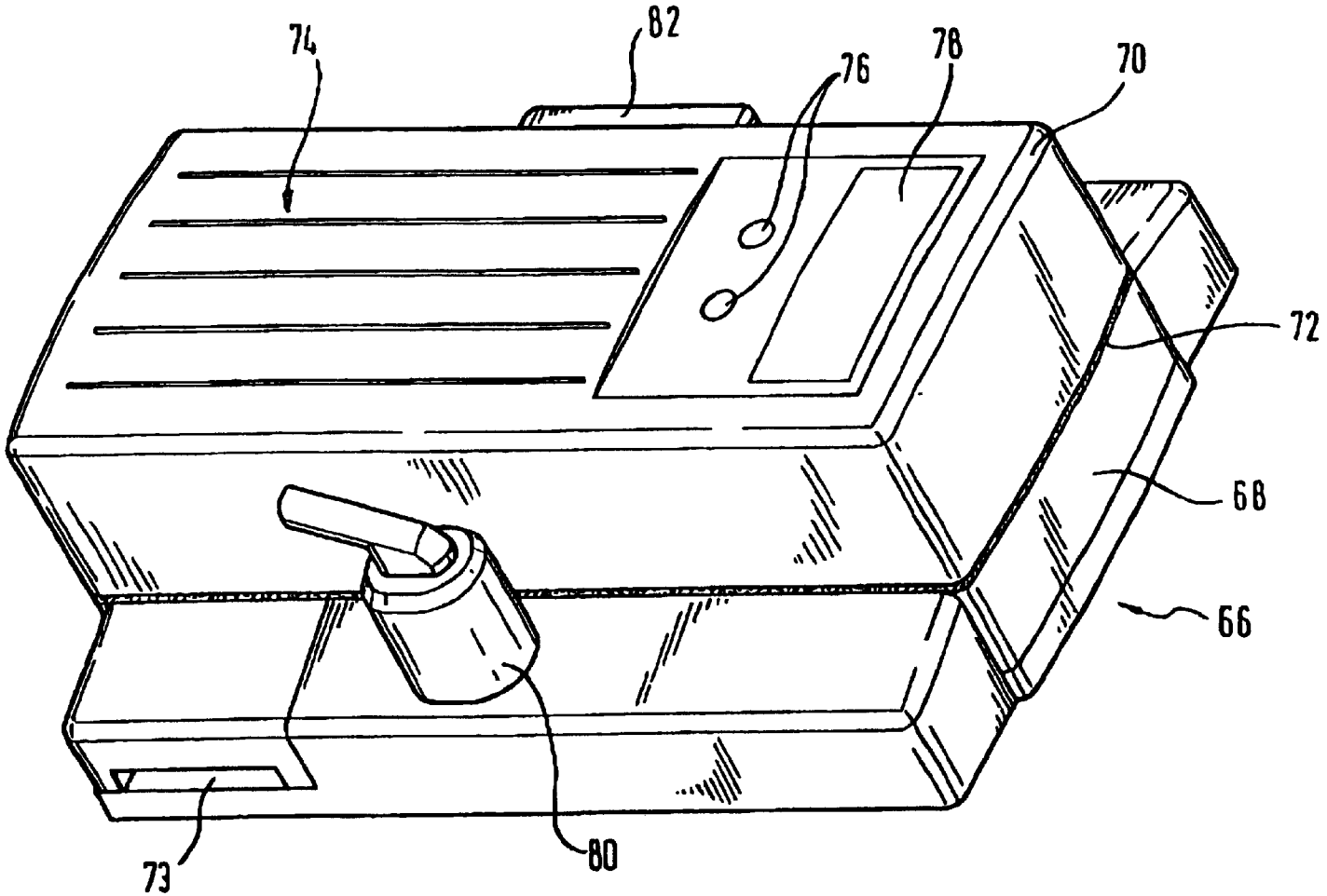

According to FIG. 5, the contacting device designed in the bus adapter 66 has an adapter bottom 68 and an adapter top 70. The adapter 66 serves as interface between the bus subscribers of a field bus system and the field bus system. The bus subscriber, for example, electrical equipment/machines and communication equipment, are connected via the adapter to the ribbon cable forming the bus line.

The adapter top 70 in adapter 66 can be mounted on the adapter bottom 68 in the fashion of a plug-in connector. An intermediate seal 72 is provided between the two adapter parts 68, 70 in order to guarantee degree of protection IP67. The adapter bottom 68 includes the contacting mechanism via which the adapter 66 is connected to the ribbon cable. The ribbon cable is passed through adapter 66 via a slit 73.

A control unit 74 having operating element 76 and a display element 78 is integrated in the adapter top 70. The adapter 66 also includes two plug connections as integral component. A power connection 80, via which the power supplied through the ribbon cable is made available to an electrical load, for example, a motor. A communications connection 82 is provided as additional plug connection via which a communications or data processing device can be connected to the ribbon cable. The communications connection 82 is designed, for example, as a connection for a circuit board connector.

This type of adapter 66 is suitable for decentralized control of machines and components in the field bus system. The equipment to be installed can be connected via adapter 66 largely independent of location at any site on the ribbon cable. The layout of a decentralized bus system is therefore made possible with adapter 66.

The adapter top 70 can be replaced simply by positioning on the adapter bottom. Adapter top 70 and adapter bottom 68 are therefore designed as a plug-in connector in which the counterplug or plug housing of such a plug-in connector is already an integral component of adapter 66. Depending on the equipment being connected, the adapter top 70 is designed differently. The adapter 66 is therefore designed in modular fashion, especially as a module. This permits simple and rapid adjustment to local requirements.

Very simple and at the same time very efficient arrangement for sealing of the entire contacting elements relative to the surrounding is guaranteed in the contacting device 2, i.e., also in the adapter 66, by the arrangement of sealing ridge 24. In particular, the use of a flat and continuous sealing plate of gasket 6 is made possible on this account. Whereas reliable sealing between gasket 6 and housing top 4 is determined by the sealing ridge 24, for sealing between gasket 6 and ribbon cable 10, it is decisive that the sealing material is displaced by the contacting screw 20, which significantly contributes to sealing. Because of this configuration, reliable sealing is guaranteed with simple means and a high degree of protection, especially a degree of protection IP67, is reached.

What is claimed is:

1. For use with a single ribbon cable having conductors and an insulating covering, a contacting device comprising:

a housing having a housing top and a housing bottom adapted to embrace the single ribbon cable;

a plurality of contact screws carried by the housing top to be screwed into the ribbon cable and thereby contact the conductors of the ribbon cable by penetrating the insulating covering of the ribbon cable;

a gasket in the form of a flat sealing plate located between the housing top and the ribbon cable to lie flat on an upper surface of the ribbon cable and individually surround the contact screws; and a sealing ridge projecting from the housing top, wherein the sealing ridge cooperates with the gasket to seal the contact screws, said sealing ridge having a cross section which tapers to a point in the direction of the gasket.

2. A contacting device as defined in claim 1, wherein the sealing ridge is molded onto the housing top.

3. A contacting device as defined in claim 1, further comprising a contacting region, wherein the plurality of contact screws are located within the contacting region, and wherein the sealing ridge completely surrounds the contacting region.

4. A contacting device as defined in claim 1, wherein the gasket has no preformed recesses adjacent the contact screws.

5. A contacting device as defined in claim 1, wherein the contact screws pass through the gasket to cooperatively provide a seal between the contact screws and the gasket.

6. A contacting device as defined in claim 5, wherein the gasket forms continuous bulges around each of the contact screws to seal the ribbon cable to the contact screws.

7. A contacting device as defined in claim 1, wherein the housing bottom further comprises a guide rail to insertably receive a guide element of the housing top.

8. A contacting device as defined in claim 7, wherein a clearance between the guide rail of the housing bottom and the guide element of the housing top provides for rotation of the housing top with respect to the housing bottom for rotatably opening and closing the housing.

9. A contacting device as defined in claim 1, wherein the housing top is part of a plug-in connector.

10. A contacting device as defined in claim 9, wherein the plug-in connector is a rectangular plug-in connector.

11. A contacting device as defined in claim 1, wherein the device is mounted in a bus adapter for a bus system.

12. A contacting device as defined in claim 11, wherein the bus adapter comprises a control unit.

13. A contacting device as defined in claim 11, wherein the bus adapter comprises an adapter bottom and an adapter top mounted on the adapter bottom.

14. A contacting device as defined in claim 11, wherein the bus adapter comprises at least one integrated plug connection.

15. A contacting device as defined in claim 1, wherein the housing top and the housing bottom are connected to form a hinge with a pivot axis and can be swiveled around the pivot axis.

* * * * *